US007641132B2

(12) United States Patent
Richards

(10) Patent No.: US 7,641,132 B2
(45) Date of Patent: Jan. 5, 2010

(54) DISPERSION AND AERATION APPARATUS FOR COMPRESSED AIR FOAM SYSTEMS

(76) Inventor: William Henry Richards, 1308 Currumbin Creek Road, Currumbin valley, Queensland, 4223 (AU)

( * ) Notice: Subject to any disclaimer, the term of this patent is extended or adjusted under 35 U.S.C. 154(b) by 0 days.

(21) Appl. No.: 11/887,672

(22) PCT Filed: Mar. 30, 2006

(86) PCT No.: PCT/AU2006/000426

§ 371 (c)(1),
(2), (4) Date: Nov. 6, 2007

(87) PCT Pub. No.: WO2006/102713

PCT Pub. Date: Oct. 5, 2006

(65) Prior Publication Data

US 2008/0245282 A1 Oct. 9, 2008

(30) Foreign Application Priority Data

Mar. 31, 2005 (AU) ..... 2005901561

(51) Int. Cl.

| | |
|---|---|
| ***B05B 7/12*** | (2006.01) |
| ***B05B 7/30*** | (2006.01) |
| ***F23D 11/46*** | (2006.01) |
| ***F23D 14/60*** | (2006.01) |

(52) U.S. Cl. ..... 239/349; 239/414; 239/417.5

(58) Field of Classification Search ..... 239/128, 239/129, 152–154, 349, 400, 414, 417.5, 239/419, 419.3, 428, 432, 289, 433, 525, 239/570, 590, 590.5, 600, 310, 318, 398; 169/9, 13–15, 24, 30, 43, 44, 46, 52, 71, 169/85, 86, 88; 366/336, 337; 111/118, 111/127

See application file for complete search history.

(56) References Cited

FOREIGN PATENT DOCUMENTS

| | | |
|---|---|---|
| CA | 2096097 A1 | 11/1994 |
| EP | 1 428 555 A1 | 6/2004 |
| FR | 2 575 082 A1 | 6/1986 |
| WO | WO 99/44749 | 9/1999 |
| WO | WO 00/03763 | 1/2000 |

*Primary Examiner*—Christopher J. Novosad
(74) *Attorney, Agent, or Firm*—Buchanan Ingersoll & Rooney PC

(57) ABSTRACT

A dispersion and aeration apparatus including a nozzle portion (11) having a first passage (14) having at least one inlet (15) and at least one outlet (16) for a first fluid, and a second passage (17) having at least one inlet (18) and at least one outlet (19) for a second material, the first passage outlets (16) located so that the first fluid mixes with the second material as it exits the second passage outlet (19) to aerate and disperse the second material in a predetermined direction.

20 Claims, 6 Drawing Sheets

DISPERSION AND AERATION APPARATUS FOR COMPRESSED AIR FOAM SYSTEMS

FIELD OF THE INVENTION

The present invention relates to dispersion apparatus and in particular to apparatus for the dispersion of fluids, particularly liquids, rapidly and in multiple directions.

BACKGROUND ART

Compressed air foam (CAF) was developed in the 1970s in Texas as an innovative approach for fighting grassland fires in areas where water is extremely scarce. The system combines two technologies, an agent to reduce the surface tension of water and compressed air to produce an expanded volume of fire extinguishing agent. The surface tension reduction, which makes water much more efficient as an extinguishing agent, is accomplished by introducing a small percentage of Class A foam concentrate into the water stream. Compressed air is then injected into the solution to expand the foam, creating a mass of foam bubbles to provide a much greater volume of extinguishing agent in a form that has the ability to stick to vertical surfaces and flow over horizontal surfaces, forming an insulating layer. The foam bubbles are more efficient at absorbing heat than plain water, whether it is in the form of a solid stream or small droplets. CAF can be discharged from both handlines and master stream devices.

There are two main types of nozzle used to disperse the CAF, namely aspirated nozzles or compressed air nozzles. A compressed air nozzle generally operates as follows: Primary mixing of the foam components occurs in a mixing chamber. The compressed air nozzle allows the injection of pressurized gas or air at a point just beyond the mixing chamber in an aftermix chamber. The injected pressurized gas in the aftermix chamber provides additional mixing of the foam and also propels the foam, resulting in an improved spray pattern. The "fineness" of the spray pattern can be altered by adjusting the amount of injected pressurized gas into the aftermix chamber. The injected pressurized gas also flushes the foam during and after every use from the aftermix chamber and the nozzle attached to the aftermix chamber, thus, eliminating the need for replacing or cleaning the nozzle after each use.

Nozzles of this type, due mainly to the use of the injected pressurised gas to both convey and expand the foam, suffer from a limited degree to which the foam can be expanded. In addition to this, the foam may have time to collapse between injection of the pressurised gas and dispersion from the nozzle.

An aspirated nozzle or eductor nozzle generally operates on a venturi basis in which, as the foam flows through the nozzle, air is drawn from outside the nozzle and injected into the foam flow. In operation, the pressure energy of the motive liquid is converted to velocity energy by the converging nozzle. The high velocity liquid flow then entrains the suction liquid. This device has a disadvantage in that the amount of air which is drawn into the nozzle is directly proportional to the flow rate of the foam through the nozzle. This limits the degree to which the foam can be expanded.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a dispersion and aeration apparatus which may at least partially overcome at least one of the abovementioned disadvantages or provide the consumer with a useful or commercial choice.

In one form, the invention resides in a dispersion and aeration apparatus including a nozzle portion having a first passage having at least one inlet and at least one outlet for a first fluid and a second passage having at least one inlet and at least one outlet for a second material, the at least one outlet from the first passage located such that the first fluid exiting said at least one outlet mixes with the second material as it exits the at least one second outlet to aerate and disperse the second material in a predetermined direction.

In a second form, the invention resides in a portable dispersion and aeration lance including a nozzle portion having a first head passage having at least one inlet and at least one outlet for a first fluid and a second head passage having at least one inlet and at least one outlet for a second material, the at least one outlet from the first passage located such that the first fluid exiting said at least one outlet mixes with the second material as it exits the at least one second outlet to aerate and disperse the second material in a predetermined direction; and a fluid connection portion including attachment portions for supplying the first and second fluids to the respective passages; and at least one body portion connecting the fluid connection portion to the head portion, the at least one body portion having first and second body passages communicating with the first and second head passages respectively.

The apparatus of the invention finds particular application in the field of fire suppression and fire fighting, and most preferably, in situations where fires are fought by volunteer fire fighters who are restricted as to the actions that can be taken during a response. For example, volunteer fire fighters are prohibited from entering a building which is on fire and are restricted to containing the fire from spreading.

The apparatus of the invention is also adapted for uses in other fields such as agriculture. Aeroponics is a sub-branch of hydroponic growing which involves misting the plant's roots with nutrient solution in air. Aeroponics is notoriously inefficient and expensive and to date there has not been a commercial implementation of the laboratory tests relating to aeroponics due to these inefficiencies. However, using the apparatus of the present invention, a nutrient solution can be foamed and introduced into the root region of a plant. The foam mixture which may be dispensed using a nozzle of the present invention has been found to last for periods as long as 6 to 7 hours. During this period, the roots of the plant can feed not only off the nutrients in the foam but also from the small amounts of water and oxygen captured in the foam itself. The inventor of the present invention terms this application "foamoponic"

Foamoponic techniques represent an entire new delivery system of nutrients, water, oxygen, minerals, trace elements and foaming agent to a plant and root system.

The foam mixture is created through the injector head and preferably delivered into a root growing chamber. The structure of a root chamber suitably enables an easy access for an inspection and control of a root system.

The formula for a plant nutrient mixture is preferably organic. The system can also be utilised with readily available fertilisers which are currently in the market place. Specialised formula can be manufactured for specific plant and tree types at grower's request.

The foam solution may be electromagnetically charged and mineral and ozone enriched before it enters a delivery network.

High pressure air and solution preferably enters the injector head and a foam of bubbles of oxygen trapped in membranes of nutrients, minerals and water can then be delivered to a root chamber.

The main advantage of this system is that it uses a considerably less amount of water compared to overhead and micro-irrigation, hydroponics and other irrigation systems. All foam mixture is utilised and absorbed by the plant with little or no wastage of either water or nutrients. This technique also gives a grower a total control of a plant growing environment. There is also a beneficial effect of oxygen delivered to a plant root system which is different to aeroponic systems. Oxygen is slowly released from a dry foam and is available to a plant for a long period of time.

This system is designed to be used for any plant crops including all vegetables, flowers, vine crops and fruit trees.

Further, the apparatus of the present invention may also find application in the area of aquaculture to inject pellets of foamed food or other substances into an aquaculture environment. This application may also allow for the addition of other materials in a foamed form into the aquaculture environment.

Still further, the apparatus of the present invention may also find application in the industrial area and particularly in the area of construction or foaming applications. For example, the apparatus is particularly well adapted to use when manufacturing a foamed or expanded polystyrene board. It is also particularly useful for manufacturing a foamed concrete board. Both types of board will then have the advantage of being lightweight through a reduction in the material used in the board but will generally also be strong through the incorporation of a honeycomb internal structure.

In a most preferred embodiment, the first fluid is pressurised air or other gas (but may be a liquid), and the second material is a material which will be aerated to form a foam material. The second material may be a fluid, a liquid or other material such as a paste or settable material or the like. The pressurised air or gas will be provided at an elevated pressure, which level may be adjustable on the basis of the degree of foaming desired by a user.

Conventional compressed air fire fighting foams and their methods of dispersion, expand water to between five and fifteen times its original volume. A common mix ratio for conventional compressed air foam is 0.2% concentrate by volume (compared to 0.5% for eductor generated foam). Under average expansion of approximately ten times, the foam consists of 0.02% concentrate, 9.98% water and 90% air.

Other benefits of compressed air foam are:

1. Compressed air foam clings to vertical and overhead fuel surfaces to protect and insulate structures from fire.
2. CAF can be pumped over much greater distances and greater heights at a given pressure than water. Good casting distances are also obtainable with CAF.
3. Clean up is easier due to the dramatic decrease in the amount of water used. Water damage is similarly decreased.
4. CAF lines are much lighter in weight than lines charged with only water and in most cases, float on water. Fire fighter fatigue is therefore reduced.
5. With the lower pressures used with CAF systems, manpower can be better utilised as in most cases, a single person can operate the hose safely.

The apparatus of the present invention may suitably be a portable apparatus, particularly the lance embodiment. The dispersion lance may typically be attachable directly to a foaming hose to supply the second material. A second hose may then be connected to supply the first fluid to the dispersion lance. The lance may be particularly well adapted to use in situations described above in relation to volunteer fire fighters. The use of the lance allows the placement of the foam inside the building without the need to enter the building.

Alternatively, the apparatus of the invention may be fixed in location, for example, one or more nozzle portions may be used in lieu of conventional sprinkler heads in a building. Typically the nozzle portions may be located in elevated positions within buildings and may even find use in vehicles and marine vessels. The connections to sources of foaming material and compressed air may be "plumbed into" the building upon construction and permanently attached to the nozzle portions. The nozzles can then be connected to an activation system (generally a part of a conventional fire detection and warning system) to allow their effective use.

The nozzle portion of the apparatus will typically be configured as a two-fluid spray nozzle. The nozzle portion will generally have a substantially cylindrical body portion with a converging tapered tip portion, at least as its external shape. The nozzle portion will generally be circular in cross-section. The tapered tip portion of the nozzle portion will preferably be a substantially solid tip. The tip portion may converge to a pointed tip or alternatively, a removable piercing point may be provided. Where provided, the piercing point will generally be formed of hardened metal adapting it to be forced through various materials to allow the nozzle portion entry.

Typically, the first and second passages will be coaxial and concentrically located about a main, longitudinal axis, with an inner wall member separating the two passages. This arrangement will generally define a fluid flow pathway inside the inner passage and another fluid flow pathway in an annular passage defined between the outside of the wall member and a surrounding outer wall member.

Typically, the second passage may be the outer, annular passage. The second passage will typically be sized to deliver a predetermined maximum flowrate of second material, typically foam.

The second passage will typically have a single inlet, located at a first end of the nozzle portion and multiple outlets located at or near a second, opposed end of the nozzle portion. Each of the multiple outlets will preferably be angled relative to the main axis of the nozzle portion to promote spreading of the foam as it exits the nozzle portion. The angle of the outlets may be chosen to provide a shaped pattern of spread of the foam. The angle may be chosen to maximize the spread of the foam and outlets may be inclined at different angles to achieve a given spread pattern.

Typically, the angle of the outlets may be between 15° and 60° but is preferably between 30° and 45°. The most preferred embodiment of the invention has eight outlets, four at 30° and four at 45°, with all of the outlets being spaced about the tapered portion of the nozzle portion. The outlets may be shaped.

The outlets may be directed either forwardly or in reverse and there may be outlets directed in a combination of directions. The nozzle may be stepped or portions of differing angles may be provided to spread the formed foam.

Each outlet may preferably be further provided with a dispersion means. The dispersion means may be an obstruction located in the flow path through the outlet to promote break-up of the flow. Typically, the obstruction may be a shaped obstruction and a tapered or pointed 3-dimensional surface is preferred. This tapered surface is generally a conical surface extending from or through the sidewall of the outlet. Preferably the conical surface will be provided at an end portion of a threaded rod which suitably allows for the adjustment of the distance which the obstruction extends into the flow path. The rod and tapered surface suitably extend substantially perpendicularly into the flow path.

According to a alternative embodiment, the dispersion means may be a mesh dispersion means which is interposed between the inlet to the nozzle portion and each of the outlets. More than one mesh dispersion means may be used and where provided, the more than one mesh dispersion means may be offset from one another to maximize the dispersion.

Each outlet typically has an opening located in the tapered section of the nozzle portion. The opening will suitably be defined by a continuous edge.

The first passage will typically have a tubular or cylindrical shape defined by an inner sidewall. The first passage is generally located within the second passage and preferably centrally located. The first passage will typically have a single inlet, preferably located at or near a first end of the nozzle portion and multiple outlets located at or near a second opposed end of the nozzle portion. There will suitably be an outlet from the first passage for each outlet from the second passage. As with the outlets from the second passage, the outlets from the first passage will typically be angled relative to the main axis of the nozzle portion. However, in contrast to the outlets from the second passage, the outlets from the first passage will typically be approximately perpendicular to the main axis of the nozzle portion. The angle of these outlets may be different to 90°, but the preferred angle is perpendicular. For example, the outlets from the first passage may extend substantially perpendicularly to the outlets from the second passage.

The outlets from the first passage may therefore be colinear to a transverse axis of the nozzle portion. Each outlet from the first passage may be located in a sidewall of an outlet from the second passage such that the outlets from the respective passages intersect. Preferably, the outlet from the first passage may be located after the dispersion means in the fluid flow path so that the fluid flow through the outlet from the second passage can be disrupted then subjected to the fluid emerging from the outlet from the first passage. The location of the outlet from the first passage in this way may suitably entrain the gas in the flow of second material to form a high volume foam.

The outlets from the first passage are preferably perpendicular to the main axis of the nozzle portion regardless of the orientation of the outlets from the second passage.

The nozzle portion of the lance may be formed from a single part, but preferably, multiple parts may be used and the parts are releasably attachable to one another.

Each outlet in the nozzle (outlets from both the first and second passages) will suitably have an opening which is defined by a continuous edge. In the most preferred embodiment, the openings of the intersecting outlets will be angled and located such that the opening of an outlet from the first passage is at least partly aligned with the opening from the second passage.

According to a preferred embodiment, the nozzle portion may be used as a part of a dispersion lance. When used in this way, the nozzle portion may be attachable to a body portion of the lance. More than one body portion may be provided and body portions may be attachable to each other to form the lance body. By using multiple body portions, the separation distance between the nozzle portion and the fluid connection portion of the lance may be adjusted. The body portions will typically be threadably attachable to each other and to the nozzle portion. The nozzle portion will generally be provided with shoulder, portions to give longitudinal rigidity and support particularly when the lance is used to puncture structures.

Each body portion will typically include a pair of tubular members adapted to be positioned concentrically, a first tubular member to connect to the first passage in the nozzle portion and a second tubular member to connect to the nozzle portion outside the first tubular member and define the second passage therebetween. The connections may be by any suitable means, for example threads or an interference fit may be used. Typically, each first tubular member may be slightly longer than each second tubular member to aid in the location and assembly of the lance.

There may be sealing members used when attaching the parts of the lance to one another to enhance the seals produced.

The fluid connection portion will typically attach to one of the body portions and usually a threaded attachment will be used. The fluid connection portion will include a first attachment portion to attach a pipe or similar conduit which also attaches to the first passage of the nozzle portion and a second attachment portion to attach a pipe or similar conduit which also attaches to the nozzle portion to define the second passage.

The fluid connection portion typically has a cylindrical body with a longitudinally extending passage therethrough. The second attachment portion will generally be an inlet for the second material located at a first end of the fluid connecting portion and the first attachment portion suitably enters the body portion of the fluid connecting portion through an opening in the sidewall of the body portion. The first attachment portion will typically extend through the opening in the sidewall of the body portion at an angle to a centrally located socket. The surrounds of the opening through which the attachment portion extends will generally be sealed.

The centrally located socket is adapted to receive a tubular member of the lance and secure it therein. The first attachment portion will suitably be rigid in order to maintain the centrally located socket within the body portion. There may be one or more bracing members provided to assist with the maintenance of a concentric configuration. If provided, the bracing members will still allow flow of the second material about the bracing members and the centrally located socket. The bracing members may be placed or shaped to agitate or disturb the flow stream of a second material as it flows past the bracing members.

Additional modifications which may easily be made to the apparatus of the invention include the provision of a slide hammer on the lance to enable the imposition of additional force when puncturing structures, one or more handles to more easily manipulate the lance and typically one or more valves will be provided to allow a user to adjust the flow of the first fluid and second material.

BRIEF DESCRIPTION OF THE DRAWINGS

Various embodiments of the invention will be described with reference to the following drawings, in which.

DETAILED DESCRIPTION OF THE PREFERRED EMBODIMENT

According to a preferred embodiment of the invention, a dispersion and aeration lance 10 is provided.

Figure 2:
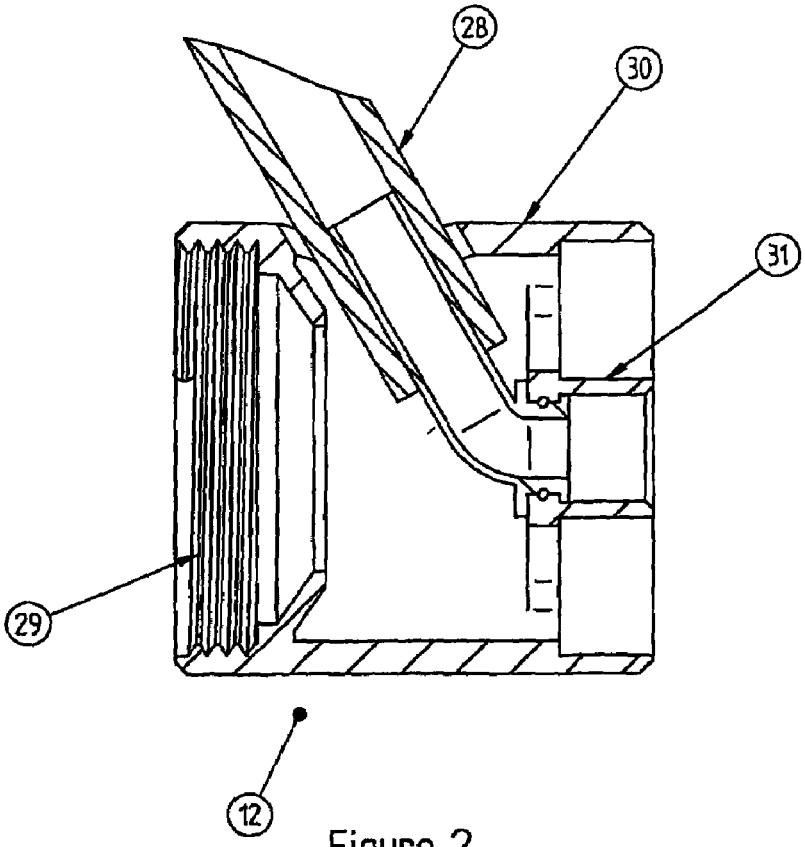
FIG. 2 is a sectional side view of a fluid connection portion according to a preferred embodiment of the present invention.
Figure 3:
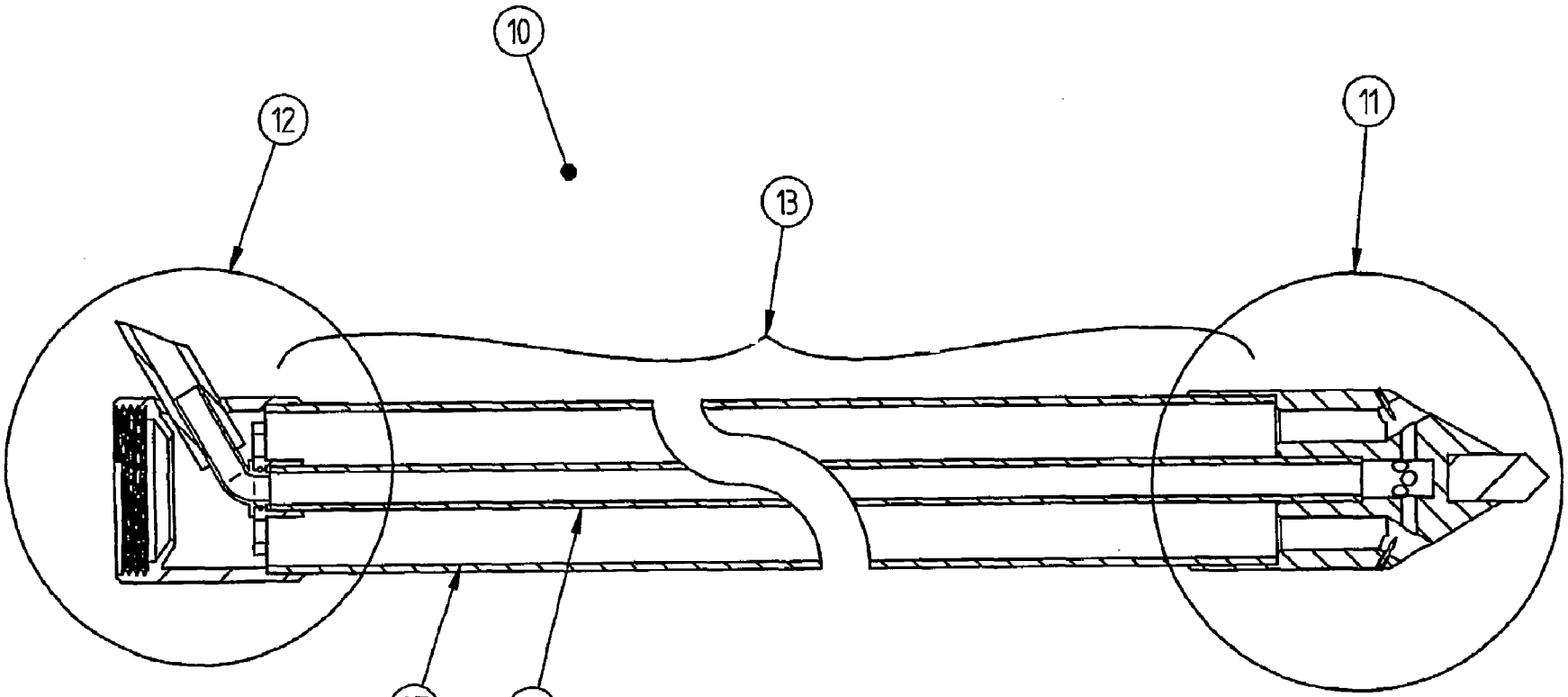
FIG. 3 is a sectional side view of a dispersion and aeration lance according to a preferred embodiment of the present invention.
Figure 4:
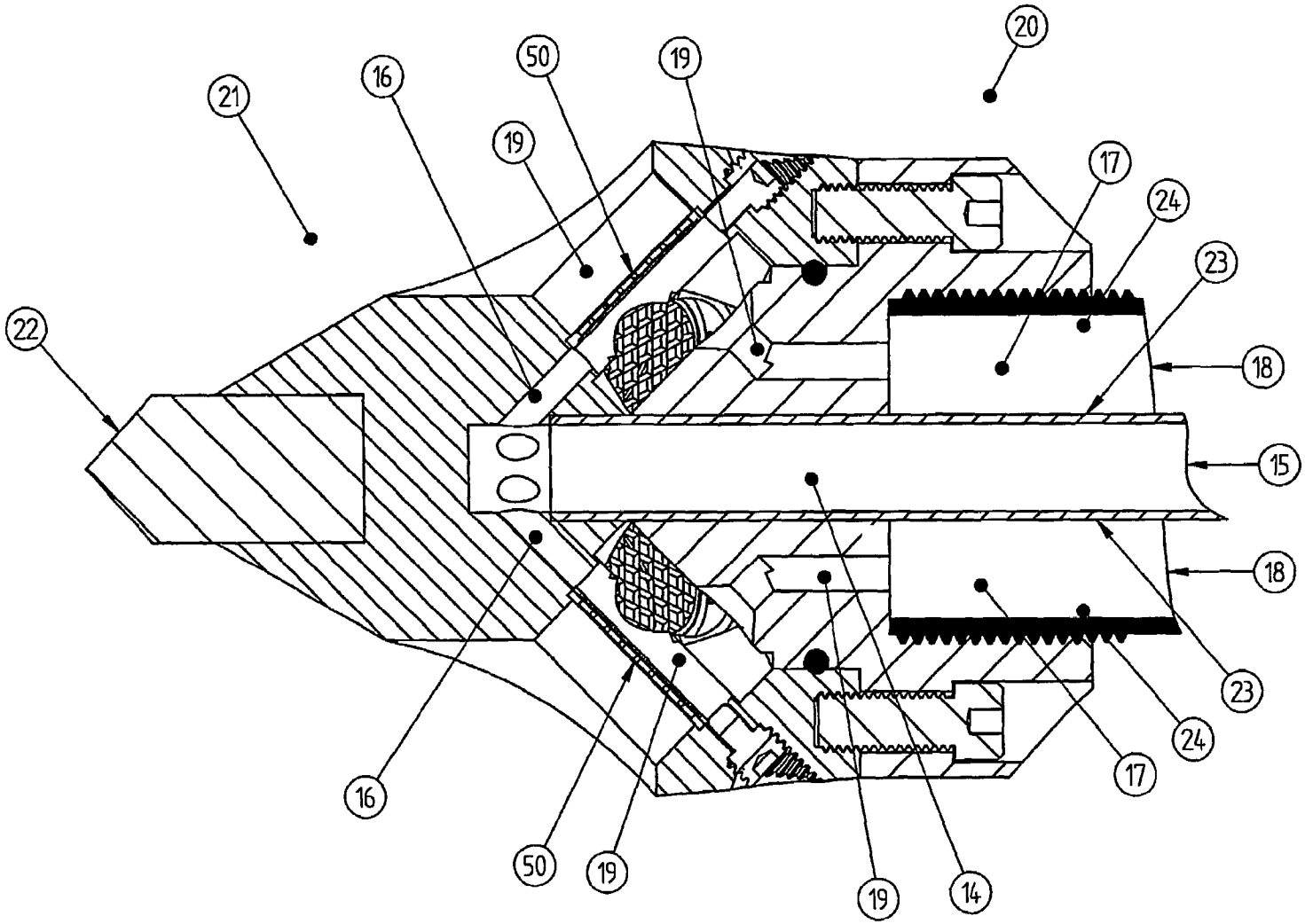
FIG. 4 is a sectional side view of a nozzle portion according to a second preferred embodiment of the present invention.
Figure 5:
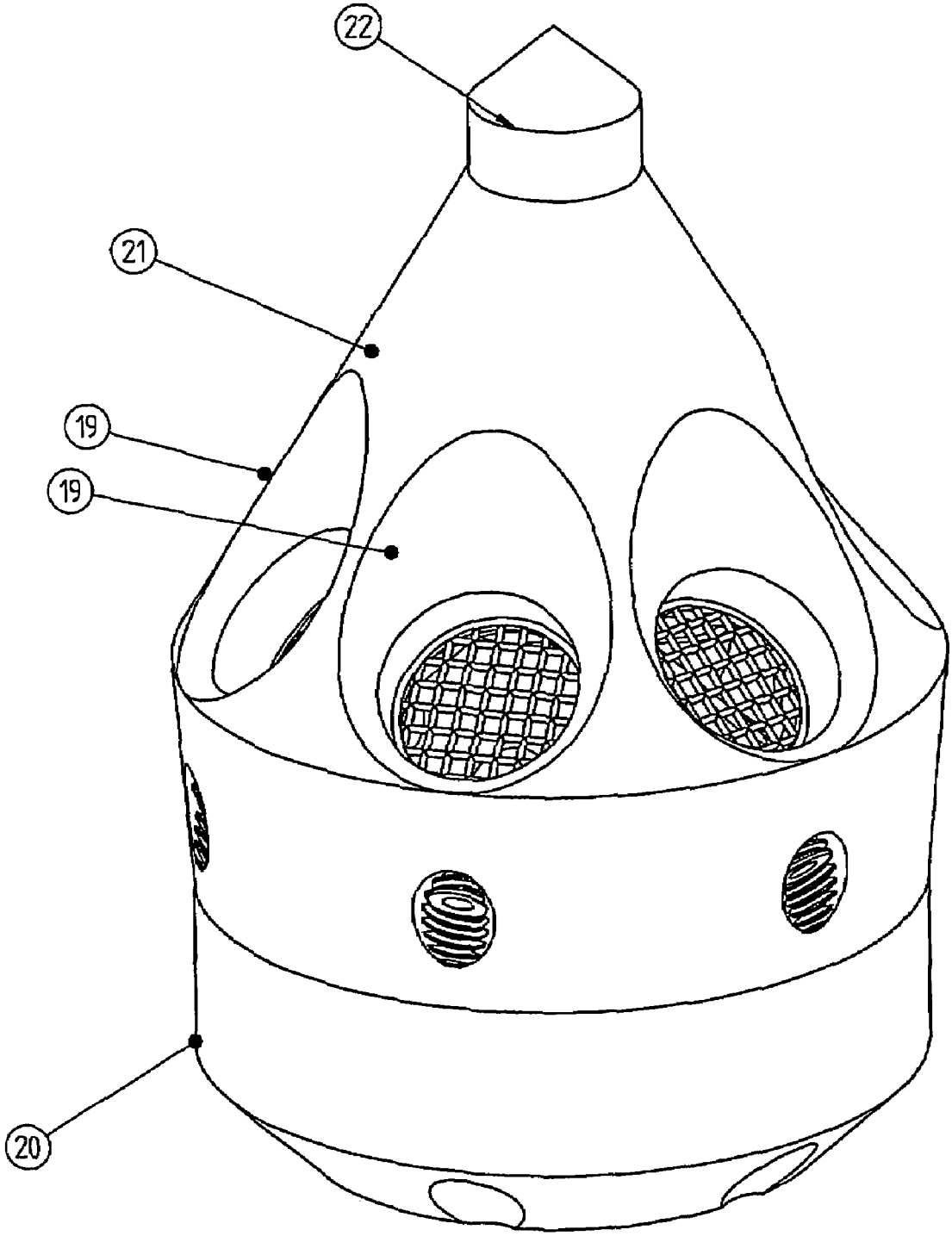
FIG. 5 is a perspective view of a prototype nozzle according to the second preferred embodiment of the present invention.
Figure 6:
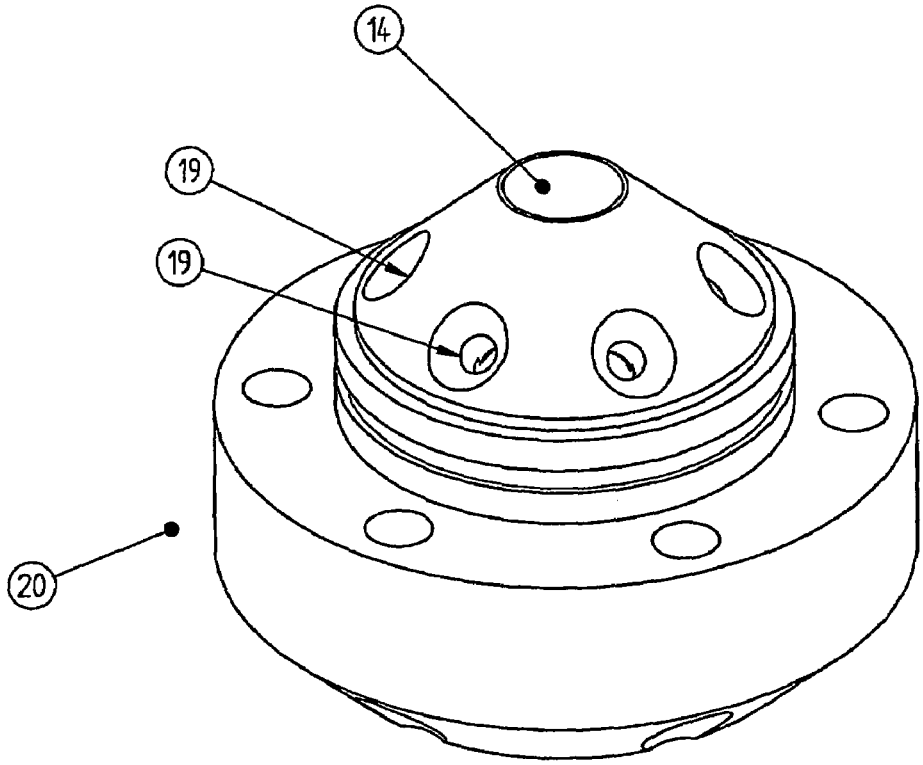
FIG. 6 is a perspective view of a first part of the nozzle portion illustrated in FIG. 5.
Figure 7:
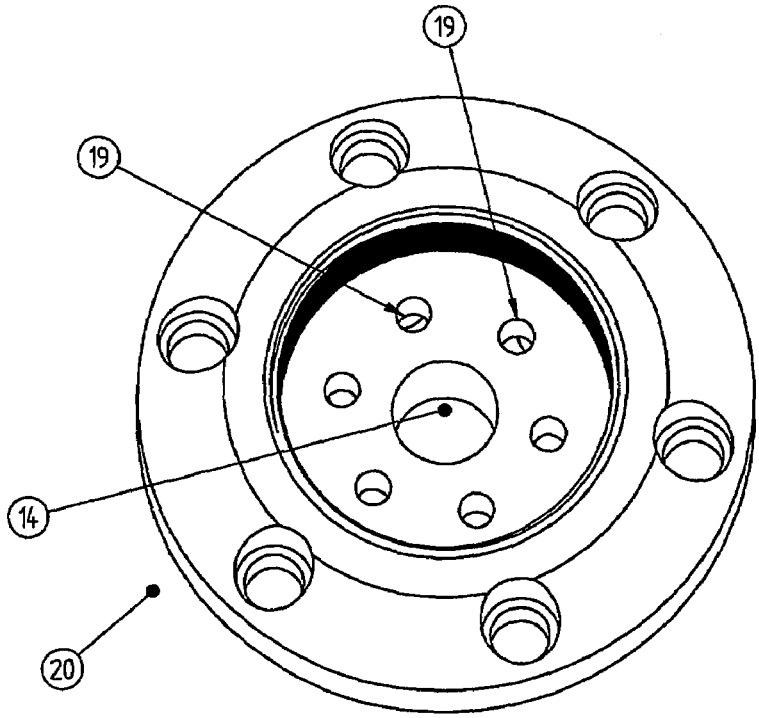
FIG. 7 is a view of the first part of the nozzle portion illustrated in FIG. 6 in the direction of the flow.
Figure 8:
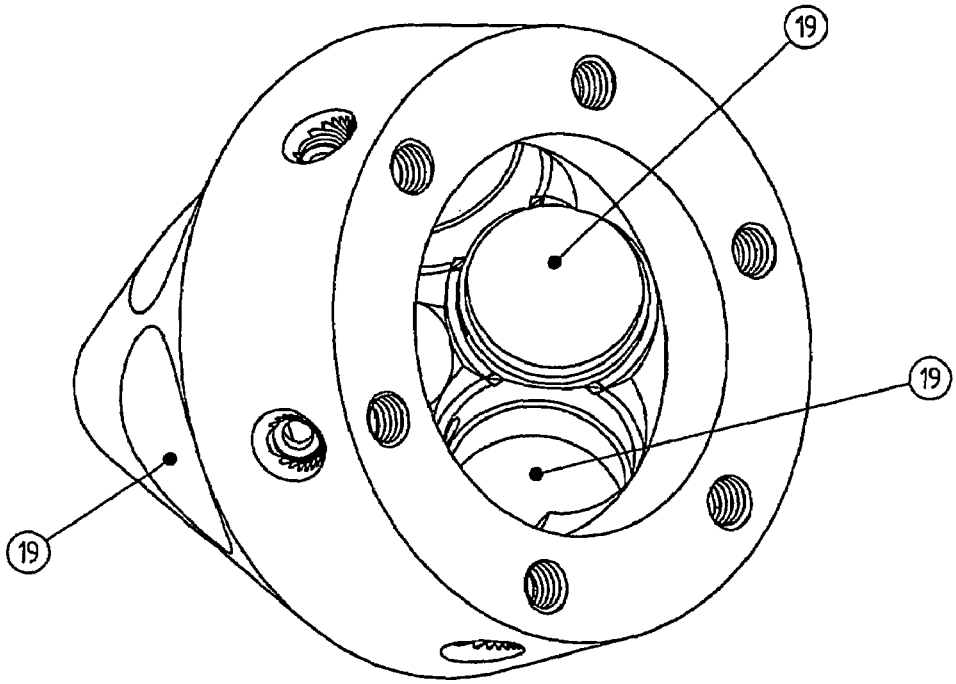
FIG. 8 is a view of a second part of the nozzle portion illustrated in FIG. 5 in the direction of the flow.
Figure 9:
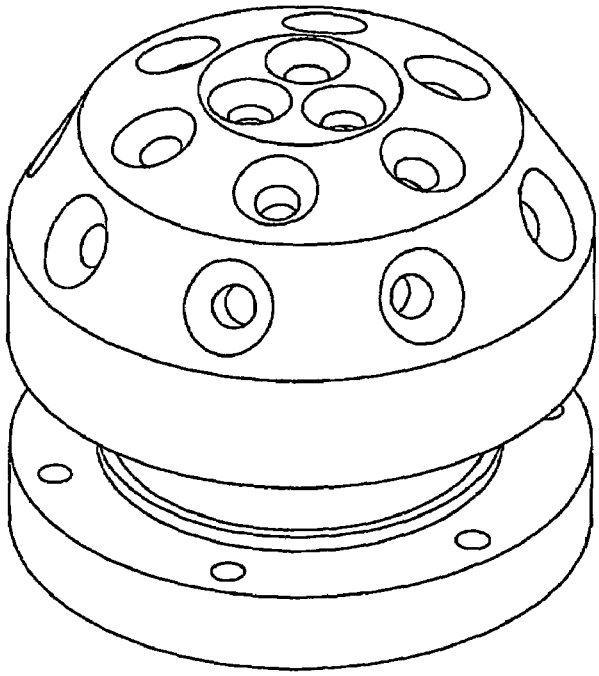
FIG. 9 is a perspective view of a prototype nozzle according to a third preferred embodiment of the invention and adapted to mounting on an overhead member in a building, vehicle or ship or such.

The dispersion lance as illustrated in FIG. 3 has a nozzle portion 11 (best illustrated in FIG. 1) and a fluid connection portion 12 (best illustrated in FIG. 2) separated by one or more body portions 13. The dispersion lance is attachable directly to a foam hose to supply the foam. A second hose can then be connected to supply the compressed gas to the dispersion lance. The use of the lance allows the placement of the foam inside the building without the need to enter the building.

Figure 1:
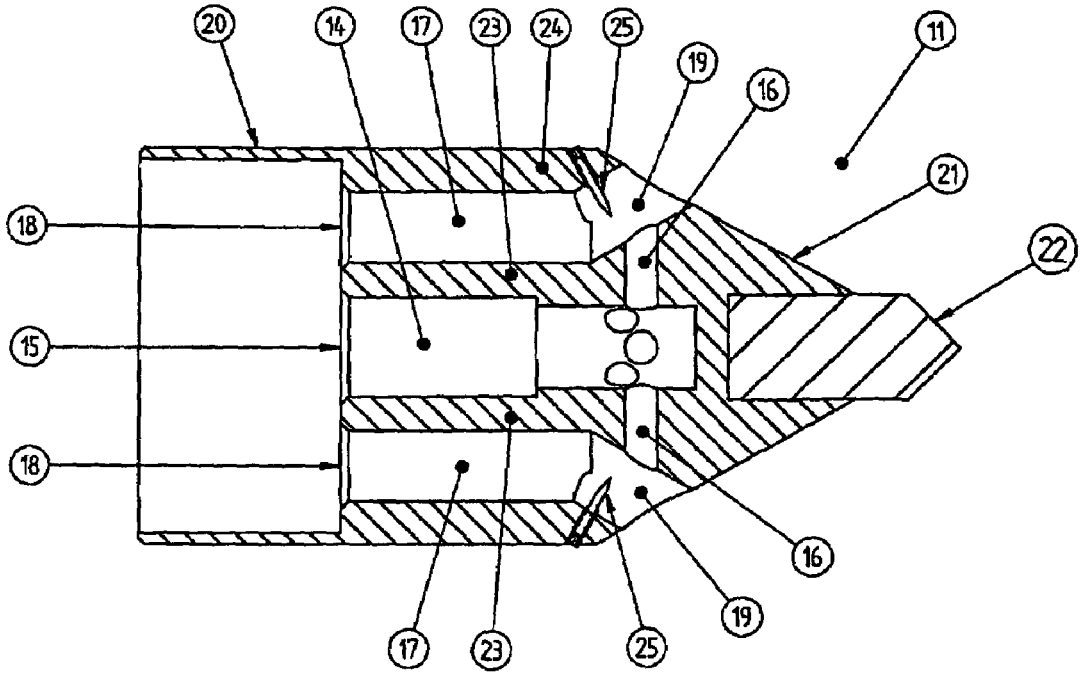
FIG. 1 is a sectional side view of a nozzle portion according to a first preferred embodiment of the present invention.

A first preferred embodiment of the nozzle portion 11 as illustrated in FIG. 1 has a compressed gas passage 14 with an inlet 15 and multiple outlets 16 generally for compressed air and a foam passage 17 having an inlet 18 and multiple outlets 19.

Each gas outlet 16 is located such that the gas exiting said gas outlet 16 mixes with the foam as it exits a foam outlet 19 to further aerate and disperse the foam in a predetermined direction. The pressurised gas is provided at an elevated pressure, which level is adjustable on the basis of the degree of foaming desired by a user.

The apparatus of this preferred form of the invention finds particular application in the field of fire fighting, particularly, in situations where fires are fought by volunteer fire fighters who are restricted as to the actions that can be taken during a response. For example, volunteer fire fighters are prohibited from entering a building which is on fire.

The nozzle portion 11 of the lance 10 is a two-fluid spray nozzle. The nozzle portion 11 has a substantially cylindrical body portion 20 with a converging tapered tip portion 21. The nozzle portion 11 has a circular cross-section. The tapered tip portion 21 of the nozzle portion 11 is further provided with a removable piercing point 22 formed of hardened metal adapting it to be forced through various materials to allow the nozzle portion 11 entry.

The foam 17 and compressed gas 14 passages are coaxial and concentrically located about a main longitudinal axis with an inner wall member 23 separating the two passages. This arrangement defines the compressed gas flow pathway inside the inner passage and the foam fluid flow pathway in an annular passage defined between the outside of the wall member 23 and a surrounding outer wall member 24.

The foam passage 17 is sized to deliver a predetermined maximum flow rate of foam.

The inlet 18 to the foam passage 17 is located at a first end of the nozzle portion 11 and the multiple outlets 19 located at or near a second opposed end of the nozzle portion 11. Each of the multiple foam outlets 19 is angled relative to the main axis of the nozzle portion 11 to promote spreading of the foam as it exits the nozzle portion 11. The angle of the outlets 19 is chosen to provide a shaped pattern of spread of the foam to maximize the spread of the foam.

The most preferred embodiment of the invention has eight foam outlets 19, four inclined at 30° and four inclined at 45° to the main longitudinal axis of the nozzle portion 11, with all of the foam outlets 19 being spaced about the tapered portion 21 of the nozzle portion 11.

Each foam outlet 19 of the preferred embodiment is provided with a dispersion means 25. The dispersion means 25 is an obstruction located in the flow path through the foam outlet 19 to promote break-up of the flow. The dispersion means 25 of the preferred embodiment is a threaded rod with a conical surface extending through the sidewall of the outlet which allows for the adjustment of the distance which the dispersion means 25 extends into the flow path. The dispersion means 25 extends substantially perpendicularly into the flow path.

The compressed gas passage 14 has a tubular or cylindrical shape defined by an inner sidewall 23. The compressed gas passage 14 is centrally located within the foam passage 17. The compressed gas passage 14 has a single inlet 15, located at or near a first end of the nozzle portion 11 and multiple outlets 16 located at or near a second opposed end of the nozzle portion 11. There is a compressed gas outlet 16 from the compressed gas passage 14 for each foam outlet 19 from the foam passage 17. The compressed gas outlets 16 from the compressed gas passage 14 are angled relative to the main axis of the nozzle portion 11. However, in contrast to the foam outlets 19 from the foam passage 17, the compressed gas outlets 16 are oriented approximately perpendicular to the main axis of the nozzle portion 11.

Each compressed gas outlet 16 is located in a sidewall of a foam outlet 19 such that the outlets from the respective passages intersect. The compressed gas outlet 16 is located after the dispersion means 25 in the fluid flow path so that the fluid flow through the foam outlet 19 is first disrupted then subjected to the fluid emerging from the compressed gas outlet 16 to form a high volume foam.

The openings of the intersecting outlets are angled and located such that the opening of a compressed gas outlet 16 is at least partly aligned with the opening of the intersecting foam outlet 19.

When used as part of a dispersion lance 10, the nozzle portion 11 is attachable to a body portion 13 of the lance 10. By using multiple body portions 13, the separation distance between the nozzle portion 11 and the fluid connection portion 12 of the lance 10 is adjustable. The body portions 13 are threadably attachable to each other and to the nozzle portion 11. The nozzle portion 11 will generally be provided with shoulder portions to give longitudinal rigidity and support, particularly when the lance 10 is used to puncture structures.

Each body portion 13 includes a pair of tubular members adapted to be positioned concentrically, a first tubular member 26 to connect to the compressed gas passage 14 in the nozzle portion 11 and a second tubular member 27 to connect to the nozzle portion 11 outside the first tubular member 26 and define the foam passage 17 therebetween.

The fluid connection portion 12 of the preferred embodiment attaches to one of the body portions 13 and usually, a threaded attachment will be used. The fluid connection portion 12 includes a compressed gas attachment portion 28 to attach a pipe or similar conduit which also attaches to the compressed gas passage 14 of the nozzle portion 11 and a foam attachment portion 29 to attach a pipe or similar conduit which also attaches to the nozzle portion 11 to define the foam passage 17.

The fluid connection portion 12 have a cylindrical body 30 with a longitudinally extending passage therethrough. The foam attachment portion 29 is an inlet for the foam located at a first end of the fluid connecting portion 12 and the compressed gas attachment portion 28 enters the body portion 30 of the fluid connecting portion 12 through an opening (seen in cross-section in FIG. 2) in the sidewall of the body portion 30. The compressed gas attachment portion 28 extends through the opening in the sidewall of the body portion 30 at an angle to a centrally located socket 31. The surrounds of the opening through which the compressed gas attachment portion 28 extends will generally be sealed. The foam attachment portion 29 will generally attach directly to a foam hose, the type of which fire departments use.

The centrally located socket 31 is adapted to receive the first tubular member 26 of the lance and secure it therein. The compressed gas attachment portion 28 will be rigid in order to maintain the centrally located socket 31 within the body portion 30. The centrally located socket 31 allows flow of the foam about the compressed gas attachment portion 28 and the centrally located socket 31.

A second preferred embodiment of the nozzle portion is illustrated in FIGS. 5 to 8.

The nozzle portion 11 also has a compressed gas passage 14 with an inlet 15 and multiple outlets 16 for compressed air and a foam passage 17 having an inlet 18 and multiple outlets 19.

Each gas outlet 16 is located such that the gas exiting said gas outlet 16 mixes with the foam as it exits a foam outlet 19 to further aerate and disperse the foam in a predetermined direction. The pressurised gas is provided at an elevated pressure, which level is adjustable on the basis of the degree of foaming desired by a user.

The nozzle portion 11 of the second preferred embodiment is formed of two parts namely a substantially cylindrical body portion 20 and a removably attachable converging tapered tip portion 21. Both parts of the nozzle portion 11 have a circular cross-section. The tapered tip portion 21 of the nozzle portion 11 is further provided with a removable piercing point 22 formed of hardened metal adapting it to be forced through various materials to allow the nozzle portion 11 entry.

The foam 17 and compressed gas 14 passages are coaxial and concentrically located about a main longitudinal axis with an inner wall member 23 separating the two passages. This arrangement defines the compressed gas flow pathway inside the inner passage and the foam fluid flow pathway in an annular passage defined between the outside of the wall member 23 and a surrounding outer wall member 24.

The foam passage 17 is sized to deliver a predetermined maximum flow rate of foam.

The inlet 18 to the foam passage 17 is located at a first end of the body portion 11 and the multiple outlets 19 located at or near an opposed end of the nozzle portion 11, in the tip portion 21. Each of the multiple foam outlets 19 is angled relative to the main axis of the nozzle portion 1 to promote spreading of the foam as it exits the nozzle portion 11. The angle of the outlets 19 is chosen to provide a shaped pattern of spread of the foam to maximize the spread of the foam.

The most preferred embodiment of the invention has eight foam outlets 19, four inclined at 30° and four inclined at 45° to the main longitudinal axis of the nozzle portion 11, with all of the foam outlets 19 being spaced about the tapered tip portion 21 of the nozzle portion 11.

Each foam outlet 19 of the second preferred embodiment is provided with a dispersion mesh 50. The dispersion mesh 50 is an obstruction located in the flow path through the foam outlet 19 to promote break-up of the flow. The dispersion mesh 50 extends substantially perpendicularly into the flow path. According to this embodiment, the dispersion mesh 50 is located after the compressed air outlet 16 meets the foam outlet 19.

The compressed gas passage 14 has a tubular or cylindrical shape defined by an inner sidewall 23. The compressed gas passage 14 is centrally located within the foam passage 17. The compressed gas passage 14 has a single inlet 15, located at or near a first end of the nozzle portion 11 and multiple outlets 16 located at or near a second opposed end of the nozzle portion 11. There is a compressed gas outlet 16 from the compressed gas passage 14 for each foam outlet 19 from the foam passage 17. The compressed gas outlets 16 from the compressed gas passage 14 are angled relative to the main axis of the nozzle portion 11. However, in contrast to the foam outlets 19 from the foam passage 17 which are angled forwardly of the top portion 21, the compressed gas outlets 16 are oriented approximately perpendicular to the foam outlets 19.

Each compressed gas outlet 16 is located in a sidewall of a foam outlet 19 such that the outlets from the respective passages intersect. The compressed gas outlet 16 is located after the dispersion mesh 50 in the fluid flow path so that the fluid flow through the foam outlet 19 is first disrupted then subjected to the fluid emerging from the compressed gas outlet 16 to form a high volume foam.

In the present specification and claims, the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

The invention claimed is:

1. A dispersion and aeration apparatus including a nozzle portion having a first passage (air) having at least one inlet and a plurality of outlets for a first fluid and a second passage (foam) having at least one inlet and a plurality of outlets for a second material, each outlet from the first passage located such that the first fluid exiting said outlet mixes with the second material as the second material exits each second outlet, to aerate and disperse the second material in a predetermined direction wherein the second passage has a single inlet located at a first end of the nozzle portion and multiple outlets located at or near a second, opposed end of the nozzle portion and each of the multiple outlets is angled relative to the main longitudinal axis of the nozzle portion to promote spreading of the foam as it exits the nozzle portion to maximize the spread of the foam.

2. A dispersion and aeration apparatus according to claim 1 wherein the first fluid is pressurised air or other gas, and the second material is a foam material.

3. A dispersion and aeration apparatus according to claim 1 wherein the apparatus is fixed in location in elevated positions within buildings, vehicles or marine vessels.

4. A dispersion and aeration apparatus according to claim 1 wherein the nozzle portion is configured as a two-fluid spray nozzle.

5. A dispersion and aeration apparatus according to claim 4 wherein the nozzle portion has a substantially cylindrical body portion with a converging tapered tip portion.

6. A dispersion and aeration apparatus according to claim 5 wherein the tapered tip portion of the nozzle portion is stepped.

7. A dispersion and aeration apparatus according to claim 1 wherein the first and second passages are coaxial and concentrically located about a main, longitudinal axis, with an inner wall member separating the two passages.

8. A dispersion and aeration apparatus according to claim 7 wherein the second passage is an outer, annular passage.

9. A dispersion and aeration apparatus according to claim 1 wherein the angle of the outlets is between 15° and 60° .

10. A dispersion and aeration apparatus according to claim 9 having at least eight outlets, at least four outlets angled at 30° and at least four angled at 45° , with all of the outlets being spaced about the tapered portion of the nozzle portion.

11. A dispersion and aeration apparatus according to claim 1 wherein each outlet is further provided with a dispersion means.

12. A dispersion and aeration apparatus according to claim 1 wherein the first passage has a single inlet located at or immediately adjacent a first end of the nozzle portion and multiple outlets are located at or immediately adjacent a second opposed end of the nozzle portion.

13. A dispersion and aeration apparatus according to claim 12 wherein each outlet from the first passage is located in a sidewall of an outlet from the second passage such that the outlets from the respective passages intersect to at least partially entrain the gas in the flow of second material.

14. A dispersion and aeration apparatus according to claim 13 wherein the outlets from the first passage are approximately perpendicular to the main axis of the nozzle portion.

15. A dispersion and aeration apparatus according to claim 13 wherein the nozzle portion is formed from multiple parts releasably attachable to one another.

16. A portable dispersion and aeration lance including a nozzle portion having a first head passage having at least one inlet and a plurality of outlets for a first fluid and a second head passage having at least one inlet and a plurality of outlets for a second material, each outlet from the first passage located such that the first fluid exiting said outlet mixes with the second material as the second material exits each second outlet to aerate and disperse the second material in a predetermined direction; and a fluid connection portion including attachment portions for supplying the first and second fluids to the respective passages; and at least one body portion connecting the fluid connection portion to the head portion, the at least one body portion having first and second body passages communicating with the first and second head passages respectively wherein the second passage has a single inlet located at a first end of the nozzle portion and multiple outlets located at or immediately adjacent a second, opposed end of the nozzle portion and each of the multiple outlets is angled relative to the main longitudinal axis of the nozzle portion to promote spreading of the foam as it exits the nozzle portion to maximize the spread of the foam.

17. A portable dispersion and aeration lance according to claim 16 wherein the pressurised air or other gas is provided at an elevated pressure, which level is adjustable on the basis of the degree of foaming desired by a user.

18. A portable dispersion and aeration lance according to claim 16 wherein the lance is attachable directly to a foam hose to supply the second material and a second hose is connected to supply the first fluid to the lance.

19. A portable dispersion and aeration lance according to claim 16 wherein the outlets are directed both forwardly and rearwardly.

20. A delivery system for delivering nutrients to a plant the system including a dispersion and aeration apparatus including a nozzle portion having a first passage having at least one inlet and at least one outlet for a first fluid and a second passage having at least one inlet and at least one outlet for a second material, the at least one outlet from the first passage located such that the first fluid exiting said at least one outlet mixes with the second material as the second material exits the at least one second outlet to aerate and disperse the second material in a predetermined direction, at least one of the first or second fluids containing plant nutrients wherein the second passage has a single inlet located at a first end of the nozzle portion and multiple outlets located at or near a second, opposed end of the nozzle portion and each of the multiple outlets is angled relative to the main longitudinal axis of the nozzle portion to promote spreading of the foam as it exits the nozzle portion to maximize the spread of the foam.

* * * * *